US009516730B2

(12) United States Patent
Fleurov et al.

(10) Patent No.: US 9,516,730 B2
(45) **Date of Patent: *Dec. 6, 2016**

(54) SYSTEMS AND METHODS FOR BUFFER GAS FLOW STABILIZATION IN A LASER PRODUCED PLASMA LIGHT SOURCE

(75) Inventors: Vladimir B. Fleurov, Escondido, CA (US); William N. Partlo, Poway, CA (US); Igor V. Fomenkov, San Diego, CA (US); Alexander I. Ershov, Escondido, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/156,188

(22) Filed: Jun. 8, 2011

(65) Prior Publication Data

US 2012/0313016 A1 Dec. 13, 2012

(51) Int. Cl.
*G21K 5/00* (2006.01)
*H05G 2/00* (2006.01)

(52) U.S. Cl.
CPC ..... *H05G 2/005* (2013.01); *H05G 2/008* (2013.01)

(58) Field of Classification Search
CPC ..... H05G 2/005; H05G 2/008
USPC ..... 250/504 R, 428, 429, 431
See application file for complete search history.

(56) References Cited

U.S. PATENT DOCUMENTS 6,452,199 B1 9/2002 Partlo et al.
7,087,914 B2 8/2006 Akins
7,164,144 B2 1/2007 Partlo
7,184,124 B2 2/2007 Harned et al.
7,372,056 B2 5/2008 Hemberg
7,402,825 B2 * 7/2008 Simmons ..... H05G 2/001 250/493.1
7,405,416 B2 7/2008 Algots
7,439,530 B2 10/2008 Ershov
7,465,946 B2 12/2008 Bowering
7,491,954 B2 2/2009 Bykanov
7,655,925 B2 * 2/2010 Bykanov ..... G03F 7/70033 250/428
7,750,327 B2 * 7/2010 Tran ..... G03F 7/70916 250/504 R
7,812,329 B2 * 10/2010 Bykanov ..... G03F 7/70033 250/492.2

(Continued)

FOREIGN PATENT DOCUMENTS

WO 2010/028899 3/2010
WO WO2010112171 A1 10/2010
WO 2011/036248 3/2011

OTHER PUBLICATIONS

Shane Thomas, PCT International Search Report dated Aug. 27, 2012 from International Application No. PCT US2012/37363, filed May 10, 2012 (3 pgs).

(Continued)

*Primary Examiner* — Wyatt Stoffa

(57) ABSTRACT

An extreme-ultraviolet (EUV) light source comprising an optic, a target material, and a laser beam passing through said optic along a beam path to irradiate said target material. The EUV light source further includes a system generating a gas flow directed toward said target material along said beam path, said system having a tapering member surrounding a volume and a plurality of gas lines, each gas line outputting a gas stream into said volume.

19 Claims, 4 Drawing Sheets

(56) References Cited

U.S. PATENT DOCUMENTS

| | | | | |
|---|---|---|---|---|
| 7,843,632 | B2 | 11/2010 | Bowering | |
| 7,872,245 | B2 | 1/2011 | Vaschenko | |
| 7,897,947 | B2 | 3/2011 | Vaschenko | |
| 8,035,092 | B2 | 10/2011 | Bykanov et al. | |
| 8,115,900 | B2 * | 2/2012 | Van De Vijver | B82Y 10/00 250/504 R |
| 2001/0006217 | A1 * | 7/2001 | Bisschops | B82Y 10/00 250/493.1 |
| 2002/0014598 | A1 * | 2/2002 | Melnychuk | B82Y 10/00 250/504 R |
| 2006/0255298 | A1 | 11/2006 | Bykanov | |
| 2006/0289806 | A1 * | 12/2006 | Simmons et al. | 250/493.1 |
| 2008/0023657 | A1 * | 1/2008 | Melnychuk | B82Y 10/00 250/504 R |
| 2008/0043321 | A1 * | 2/2008 | Bowering | G02B 5/0891 359/359 |
| 2008/0179548 | A1 | 7/2008 | Bykanov | |
| 2009/0057567 | A1 * | 3/2009 | Bykanov | G03F 7/70033 250/429 |
| 2009/0154642 | A1 * | 6/2009 | Bykanov | G03F 7/70033 378/34 |
| 2009/0224179 | A1 * | 9/2009 | Shirai | G03F 7/70033 250/492.1 |
| 2010/0127186 | A1 * | 5/2010 | Bykanov | B82Y 10/00 250/423 P |
| 2010/0140514 | A1 * | 6/2010 | Bykanov | G03F 7/70033 250/504 R |
| 2010/0176310 | A1 | 7/2010 | Moriya Masato et al. | |
| 2010/1071049 | | 7/2010 | Moriya Masato et al. | |
| 2010/0258749 | A1 * | 10/2010 | Partlo | H05G 2/003 250/504 R |
| 2010/0294953 | A1 | 11/2010 | Vaschenko | |
| 2010/0327192 | A1 * | 12/2010 | Fomenkov | G03F 7/70033 250/504 R |
| 2011/0140008 | A1 * | 6/2011 | Bergstedt | H05G 2/008 250/504 R |
| 2011/0240890 | A1 * | 10/2011 | Govindaraju | H05G 2/001 250/504 R |
| 2011/0253349 | A1 * | 10/2011 | Ershov | G02B 7/008 165/109.1 |
| 2012/0182536 | A1 * | 7/2012 | Loopstra | G03F 7/70033 355/67 |
| 2012/0305810 | A1 * | 12/2012 | Ershov | G03F 7/70033 250/504 R |
| 2013/0088697 | A1 * | 4/2013 | Labetski | G03F 7/70033 355/67 |

OTHER PUBLICATIONS

Shane Thomas, PCT Written Opinion, dated Aug. 27, 2012 from International Application No. PCT US2012/37363, filed May 10, 2012 (4 pgs).

Supplementary European Search Report in counterpart EP Application 127972560.0-1556/2719261 PCT/US2012037363, mailed on Mar. 5, 2015 (7 pages).

Office Action in counterpart JP Application No. 2014-514465, Mailed Mar. 23, 2016 in Japanese Language(2 pages).

Office Action in counterpart JP Application No. 2014-514465, Mailed Mar. 23, 2016 English Translation of item #2 (2 pages).

* cited by examiner

SYSTEMS AND METHODS FOR BUFFER GAS FLOW STABILIZATION IN A LASER PRODUCED PLASMA LIGHT SOURCE

FIELD

The present application relates to extreme ultraviolet ("EUV") light sources providing EUV light from a plasma created from a source material and collected and directed to an intermediate location for utilization outside of the EUV light source chamber, e.g., for semiconductor integrated circuit manufacturing photolithography e.g., at wavelengths of around 100 nm and below.

BACKGROUND

Extreme ultraviolet ("EUV") light, e.g., electromagnetic radiation having wavelengths of around 5-100 nm or less (also sometimes referred to as soft x-rays), and including light at a wavelength of about 13 nm, can be used in photolithography processes to produce extremely small features in substrates, e.g., silicon wafers.

Methods to produce EUV light include, but are not necessarily limited to, converting a target material into a plasma state that has an element, e.g., xenon, lithium or tin, with an emission line in the EUV range.

In one such method, often termed laser produced plasma ("LPP"), the required plasma can be produced by irradiating a target material, for example in the form of a droplet, stream or cluster of material, with a laser beam. In this regard, $CO_2$ lasers outputting light at middle infra-red wavelengths, i.e., wavelengths in the range of about 9.0 μm to 11.0 μm, may present certain advantages as a drive laser irradiating a target material in an LPP process. This may be especially true for certain target materials, for example, materials containing tin. One advantage may include the ability to produce a relatively high conversion efficiency between the drive laser input power and the output EUV power.

For LPP processes, the plasma is typically produced in a sealed vessel such as a vacuum chamber, and monitored using various types of metrology equipment. In addition to generating EUV radiation, these plasma processes also typically generate undesirable by-products in the plasma chamber which can include heat, high energy ions and scattered debris from plasma formation such as source material vapor and/or clumps/microdroplets of source material that is not fully ionized in the plasma formation process.

Unfortunately, plasma formation by-products can potentially damage or reduce the operational efficiency of the various plasma chamber optical elements including, but not limited to, mirrors including multi-layer mirrors (MLM's) capable of EUV reflection at normal incidence and/or grazing incidence, the surfaces of metrology detectors, windows used to image the plasma formation process, and the laser input optic, which may, for example, be a window or focusing lens.

The heat, high energy ions and/or source material debris may be damaging to the optical elements in a number of ways, including heating them, coating them with materials which reduce light transmission, penetrating into them and, e.g., damaging structural integrity and/or optical properties, e.g., the ability of a mirror to reflect light at such short wavelengths, corroding or eroding them and/or diffusing into them.

The use of a buffer gas such as hydrogen, helium, argon or combinations thereof has been suggested. The buffer gas may be present in the chamber during plasma production and may act to slow plasma created ions to reduce optic degradation and/or increase plasma efficiency. For example, a buffer gas pressure sufficient to reduce the ion energy of plasma generated ions to below about 100 eV before the ions reach the surface of an optic may be provided in the space between the plasma and optic.

In some implementations, the buffer gas may be introduced into the vacuum chamber and removed therefrom using one or more pumps. This may allow heat, vapor, cleaning reaction products and/or particles to be removed from the vacuum chamber. The exhausted gas may be discarded or, in some cases, the gas may be processed, e.g. filtered, cooled, etc. and reused. The buffer gas flows can also be used to direct particles away from critical surfaces such as the surface of the mirrors, lenses, windows, detectors, etc. In this regard, turbulent flows which can be characterized as having eddies, which can include fluid swirling and be accompanied by a reverse current, are undesirable because they may include flows that are directed toward a critical surface. These reverse current flows may increase surface deposits by transporting material to critical surfaces. Turbulent flows can also de-stabilize a target material droplet stream in a somewhat random manner. In general, this destabilization cannot be easily compensated for, and as a consequence, may adversely affect the ability of the light source to successfully irradiate relatively small target material droplets accurately.

Removal of deposits from optics in an LPP light source using one or more chemical species having a chemical activity with the deposited material have been suggested. For example, the use of halogen containing compounds such as bromides, chlorides, etc. has been disclosed. When tin is included in the plasma target material, one promising cleaning technique involves the use of hydrogen radicals to remove tin and tin-containing deposits from an optic. In one mechanism, hydrogen radicals combine with deposited tin forming a tin hydride vapor, which can then be removed from the vacuum chamber. However, the tin hydride vapor can decompose and redeposit tin if it is directed back toward the optic's surface, for example, by a reverse current generated by a turbulence eddy. This, in turn, implies that a reduced-turbulence flow (and if possible a laminar flow) that is directed away from the surface of an optic may reduce re-deposition by cleaning reaction product decomposition.

With the above in mind, Applicants disclose systems and methods for buffer gas flow stabilization in a laser produced plasma light source.

DETAILED DESCRIPTION

Figure 1:
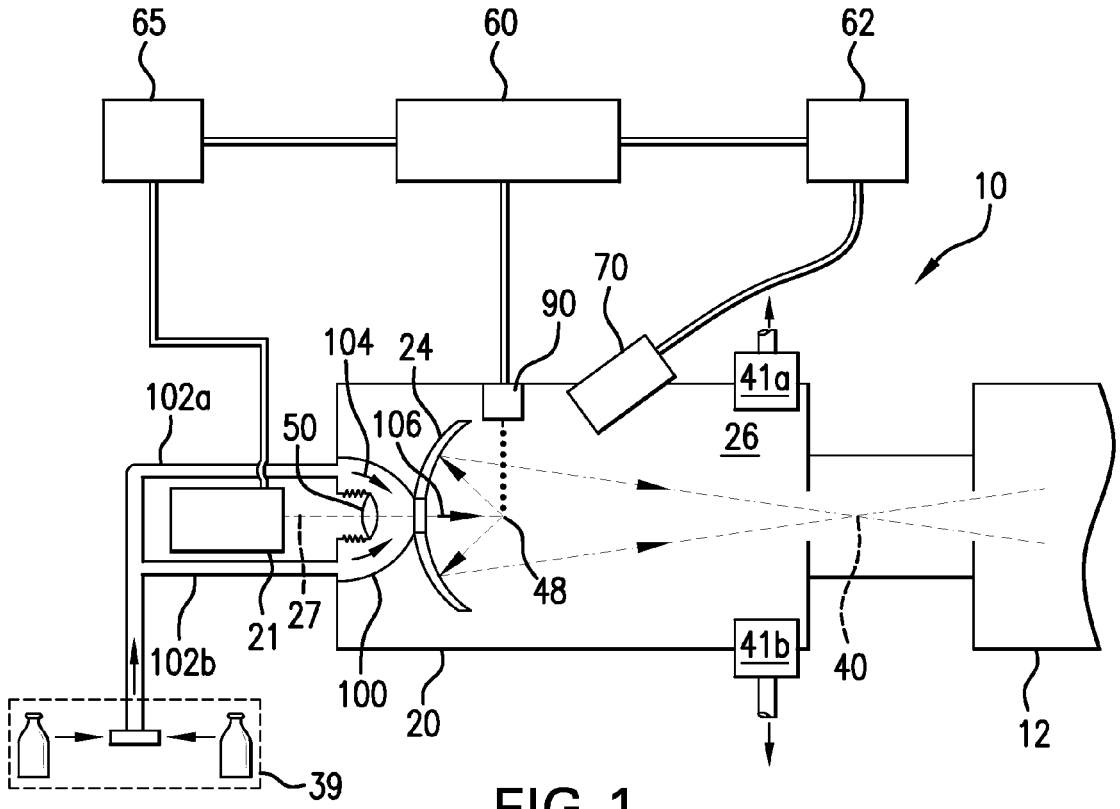
FIG. 1 shows a simplified schematic view of an EUV light source coupled with an exposure device; the light source having a system for guiding a gas flow around an optic generally along beam path and toward the irradiation region while maintaining the gas in a substantially turbulent free state.

With initial reference to FIG. 1 there is shown a simplified, schematic, sectional view, according to one aspect of an embodiment, of selected portions of an EUV photolithography apparatus, generally designated 10. The apparatus 10 may be used, for example, to expose a substrate such as a resist coated wafer, flat panel workpiece, etc., with a patterned beam of EUV light.

For the apparatus 10 an exposure device 12 utilizing EUV light, (e.g., an integrated circuit lithography tool such as a stepper, scanner, step and scan system, direct write system, device using a contact and/or proximity mask, etc. . . . ) may be provided having one or more optics, for example, to illuminate a patterning optic, such as a reticle, to produce a patterned beam, and one or more reduction projection optic (s), for projecting the patterned beam onto the substrate. A mechanical assembly may be provided for generating a controlled relative movement between the substrate and patterning means.

As used herein, the term "optic" and its derivatives includes, but is not necessarily limited to, one or more components which reflect and/or transmit and/or operate on incident light and includes, but is not limited to, one or more lenses, windows, filters, wedges, prisms, grisms, gradings, transmission fibers, etalons, diffusers, homogenizers, detectors and other instrument components, apertures, axicons and mirrors including multi-layer mirrors, near-normal incidence mirrors, grazing incidence mirrors, specular reflectors, diffuse reflectors and combinations thereof. Moreover, unless otherwise specified, neither the term "optic" nor its derivatives, as used herein, are meant to be limited to components which operate solely or to advantage within one or more specific wavelength range(s) such as at the EUV output light wavelength, the irradiation laser wavelength, a wavelength suitable for metrology or some other wavelength.

FIG. 1 illustrates a specific example in which an apparatus 10 includes an LPP light source 20 for producing EUV light for substrate exposure. As shown, a system 21 for generating a train of light pulses and delivering the light pulses into a light source chamber 26 may be provided. For the apparatus 10, the light pulses may travel along one or more beam paths 27 from the system 21 and into the chamber 26 to illuminate one or more targets at an irradiation region 48 to produce an EUV light output for substrate exposure in the exposure device 12.

Suitable lasers for use in the system 21 shown in FIG. 1, may include a pulsed laser device, e.g., a pulsed gas discharge $CO_2$ laser device producing radiation in range between 9 and 11 μm, e.g., with DC or RF excitation, operating at relatively high power, e.g., 10 kW or higher and high pulse repetition rate, e.g., 40 kHz or more. In one particular implementation, the laser may be an axial-flow RF-pumped $CO_2$ laser having an oscillator-amplifier configuration (e.g., master oscillator/power amplifier (MOPA) or power oscillator/power amplifier (POPA)) with multiple stages of amplification and having a seed pulse that is initiated by a Q-switched oscillator with relatively low energy and high repetition rate, e.g., capable of 100 kHz operation. From the oscillator, the laser pulse may then be amplified, shaped and/or focused before reaching the irradiation region 48. Continuously pumped $CO_2$ amplifiers may be used for the laser system 21. For example, a suitable $CO_2$ laser device having an oscillator and three amplifiers (O-PA1-PA2-PA3 configuration) is disclosed in U.S. patent application Ser. No. 11/174,299 filed on Jun. 29, 2005, entitled, LPP EUV LIGHT SOURCE DRIVE LASER SYSTEM, now U.S. Pat. No. 7,439,530, issued on Oct. 21, 2008, the entire contents of which are hereby incorporated by reference herein.

Alternatively, the laser may be configured as a so-called "self-targeting" laser system in which the droplet serves as one mirror of the optical cavity. In some "self-targeting" arrangements, an oscillator may not be required. Self-targeting laser systems are disclosed and claimed in U.S. patent application Ser. No. 11/580,414 filed on Oct. 13, 2006, entitled, DRIVE LASER DELIVERY SYSTEMS FOR EUV LIGHT SOURCE, now U.S. Pat. No. 7,491,954, issued on Feb. 17, 2009, the entire contents of which are hereby incorporated by reference herein.

Depending on the application, other types of lasers may also be suitable, e.g., an excimer or molecular fluorine laser operating at high power and high pulse repetition rate. Other examples include, a solid state laser, e.g., having a fiber, rod, slab, or disk-shaped active media, other laser architectures having one or more chambers, e.g., an oscillator chamber and one or more amplifying chambers (with the amplifying chambers in parallel or in series), a master oscillator/power oscillator (MOPO) arrangement, a master oscillator/power ring amplifier (MOPRA) arrangement, or a solid state laser that seeds one or more excimer, molecular fluorine or $CO_2$ amplifier or oscillator chambers, may be suitable. Other designs may be suitable.

In some instances, a target may first be irradiated by a pre-pulse and thereafter irradiated by a main pulse. Pre-pulse and main pulse seeds may be generated by a single oscillator or two separate oscillators. In some setups, one or more common amplifiers may be used to amplify both the pre-pulse seed and main pulse seed. For other arrangements, separate amplifiers may be used to amplify the pre-pulse and main pulse seeds. For example, the seed laser may be a $CO_2$ laser having a sealed gas including $CO_2$ at sub-atmospheric pressure, e.g., 0.05-0.2 atm, that is pumped by a radio-frequency (RF) discharge. With this arrangement, the seed laser may self-tune to one of the dominant lines such as the 10P(20) line having wavelength 10.5910352 μm. In some cases, Q switching may be employed control seed pulse parameters.

The amplifier may have two (or more) amplification units each having its own chamber, active media and excitation source, e.g., pumping electrodes. For example, for the case where the seed laser includes a gain media including $CO_2$, as described above, suitable lasers for use as amplification units, may include an active media containing $CO_2$ gas that is pumped by DC or RF excitation. In one particular implementation, the amplifier may include a plurality, such as three to five, axial-flow, RF-pumped (continuous or pulsed) $CO_2$ amplification units having a total gain length of about 10-25 meters, and operating, in concert, at relatively high power, e.g., 10 kW or higher. Other types of amplification units may have a slab geometry or co-axial geometry (for gas media). In some cases, a solid state active media may be employed, using rod or disk shaped gain modules, or—fiber based gain media.

The laser system 21 may include a beam conditioning unit having one or more optics for beam conditioning such as expanding, steering, and/or shaping the beam between the laser source system 21 and irradiation site 48. For example, a steering system, which may include one or more mirrors, prisms, lenses, spatial filters, etc., may be provided and arranged to steer the laser focal spot to different locations in the chamber 26. In one setup, the steering system may include a first flat mirror mounted on a tip-tilt actuator which may move the first mirror independently in two dimensions, and a second flat mirror mounted on a tip-tilt actuator which may move the second mirror independently in two dimensions. With this arrangement, the steering system may controllably move the focal spot in directions substantially orthogonal to the direction of beam propagation.

A focusing assembly may be provided to focus the beam to the irradiation site 48 and adjust the position of the focal spot along the beam axis. For the focusing assembly, an optic 50 such as a focusing lens or mirror may be used that is coupled to an actuator 52 (shown in FIG. 2) such as a stepper motor, servo motor, piezoelectric transducer, etc., for movement in a direction along the beam axis to move the focal spot along the beam axis. In one arrangement, the optic 50 may be a 177 mm lens made of optical grade ZnSe and having a clear aperture of about 135 mm. With this arrangement, a beam having a diameter of about 120 mm can be comfortably focused. Further details regarding beam conditioning systems are provided in U.S. patent application Ser. No. 10/803,526, filed on Mar. 17, 2004, entitled A HIGH REPETITION RATE LASER PRODUCED PLASMA EUV LIGHT SOURCE, now U.S. Pat. No. 7,087,914, issued on Aug. 8, 2006; U.S. Ser. No. 10/900,839 filed on Jul. 27, 2004, entitled EUV LIGHT SOURCE, now U.S. Pat. No. 7,164,144, issued on Jan. 16, 2007, and U.S. patent application Ser. No. 12/638,092, filed on Dec. 15, 2009, entitled BEAM TRANSPORT SYSTEM FOR EXTREME ULTRAVIOLET LIGHT SOURCE, the contents of each of which are hereby incorporated by reference.

As further shown in FIG. 1, the EUV light source 20 may also include a target material delivery system 90, e.g., delivering droplets of a target material such as tin into the interior of chamber 26 to irradiation region 48, where the droplets will interact with one or more light pulses, e.g., zero, one or more pre-pulses and thereafter one or more main pulses from the system 21, to ultimately produce plasma and generate an EUV emission to expose a substrate such as a resist coated wafer in the exposure device 12. More details regarding various droplet dispenser configurations and their relative advantages may be found in U.S. patent application Ser. No. 12/721,317, filed on Mar. 10, 2010, published on Nov. 25, 2010, as U.S. 2010/0294953A1, entitled LASER PRODUCED PLASMA EUV LIGHT SOURCE; U.S. Ser. No. 12/214,736, filed on Jun. 19, 2008, published on Sep. 17, 2009, as U.S. 2009/0230326A1, entitled SYSTEMS AND METHODS FOR TARGET MATERIAL DELIVERY IN A LASER PRODUCED PLASMA EUV LIGHT SOURCE; U.S. patent application Ser. No. 11/827,803, filed on Jul. 13, 2007, published on Jan. 15, 2009, as U.S. 2009/0014668A1, entitled LASER PRODUCED PLASMA EUV LIGHT SOURCE HAVING A DROPLET STREAM PRODUCED USING A MODULATED DISTURBANCE WAVE; U.S. patent application Ser. No. 11/358,988, filed on Feb. 21, 2006, entitled LASER PRODUCED PLASMA EUV LIGHT SOURCE WITH PRE-PULSE, and published on Nov. 16, 2006, as US2006/0255298A1; U.S. patent application Ser. No. 11/067,124, filed on Feb. 25, 2005, entitled METHOD AND APPARATUS FOR EUV PLASMA SOURCE TARGET DELIVERY; now U.S. Pat. No. 7,405,416, issued on Jul. 29, 2008; and U.S. patent application Ser. No. 11/174,443, filed on Jun. 29, 2005, entitled LPP EUV PLASMA SOURCE MATERIAL TARGET DELIVERY SYSTEM, now U.S. Pat. No. 7,372,056, issued on May 13, 2008; the contents of each of which are hereby incorporated by reference.

The target material may include, but is not necessarily limited to, a material that includes tin, lithium, xenon or combinations thereof. The EUV emitting element, e.g., tin, lithium, xenon, etc., may be in the form of liquid droplets and/or solid particles contained within liquid droplets. For example, the element tin may be used as pure tin, as a tin compound, e.g., $SnBr_4$, $SnBr_2$, $SnH_4$, as a tin alloy, e.g., tin-gallium alloys, tin-indium alloys, tin-indium-gallium alloys, or a combination thereof. Depending on the material used, the target material may be presented to the irradiation region 48 at various temperatures including room temperature or near room temperature (e.g., tin alloys, $SnBr_4$), at an elevated temperature, (e.g., pure tin) or at temperatures below room temperature, (e.g., $SnH_4$), and in some cases, can be relatively volatile, e.g., $SnBr_4$. More details concerning the use of these materials in an LPP EUV light source is provided in U.S. patent application Ser. No. 11/406,216, filed on Apr. 17, 2006, entitled ALTERNATIVE FUELS FOR EUV LIGHT SOURCE, now U.S. Pat. No. 7,465,946, issued on Dec. 16, 2008, the contents of which are hereby incorporated by reference herein.

Continuing with reference to FIG. 1, the apparatus 10 may also include an EUV controller 60, which may also include a drive laser control system 65 for triggering power input to one or more gain modules (RF generator lamps, for example) and/or other laser devices in the system 21 to thereby generate light pulses for delivery into the chamber 26, and/or for controlling movement of optics in the beam conditioning unit. The apparatus 10 may also include a droplet position detection system which may include one or more droplet imagers 70 that provide an output indicative of the position of one or more droplets, e.g., relative to the irradiation region 48. The imager(s) 70 may provide this output to a droplet position detection feedback system 62, which can, e.g., compute a droplet position and trajectory, from which a droplet error can be computed, e.g., on a droplet-by-droplet basis, or on average. The droplet error may then be provided as an input to the controller 60, which can, for example, provide a position, direction and/or timing correction signal to the system 21 to control a source timing circuit and/or to control movement of optics in the beam conditioning unit, e.g., to change the focal spot location and/or focal power of the light pulses being delivered to the irradiation region 48 in the chamber 26. Also for the EUV light source 20, the target material delivery system 90 may have a control system operable in response to a signal (which in some implementations may include the droplet error described above, or some quantity derived therefrom) from the controller 60, to e.g., modify the release point, release timing and/or droplet modulation to correct for errors in the droplets arriving at the desired irradiation region 48.

Continuing with FIG. 1, the apparatus 10 may also include an optic 24 such as a near-normal incidence collector mirror having a reflective surface in the form of a prolate spheroid (i.e., an ellipse rotated about its major axis) having, e.g., a graded multi-layer coating with alternating layers of Molybdenum and Silicon, and in some cases, one or more high temperature diffusion barrier layers, smoothing layers, capping layers and/or etch stop layers. FIG. 1 shows that the optic 24 may be formed with an aperture to allow the light pulses generated by the system 21 to pass through and reach the irradiation region 48. As shown, the optic 24 may be, e.g., a prolate spheroid mirror that has a first focus within or near the irradiation region 48 and a second focus at a so-called intermediate region 40, where the EUV light may be output from the EUV light source 20 and input to an exposure device 12 utilizing EUV light, e.g., an integrated circuit lithography tool. A temperature control system 35 may be positioned on or near the backside of the optic 24 to selectively heat and/or cool the optic 24. For example, the temperature control system 35 (shown in FIG. 2) may include a conductive block formed with passages through which a heat transfer fluid may be caused to flow. It is to be appreciated that other optics may be used in place of the prolate spheroid mirror for collecting and directing light to an intermediate location for subsequent delivery to a device utilizing EUV light, for example, the optic may be a parabola rotated about its major axis or may be configured to deliver a beam having a ring-shaped cross-section to an intermediate location, see e.g., U.S. patent application Ser. No. 11/505,177, filed on Aug. 16, 2006, now U.S. Pat. No. 7,843,632, issued on Nov. 30, 2010, entitled EUV OPTICS, the contents of which are hereby incorporated by reference.

Continuing with FIG. 1, a gas 39 may be introduced via lines 102*a,b* into the chamber 26 as shown. Also shown, the gas 39 may be directed around optic 50 in the direction of arrow 104, through an aperture formed in the optic 24 for flow generally along beam path 27 and toward the irradiation region 48 in the direction of arrow 106. With this arrangement, the flow of gas 39 may reduce the flow/diffusion of plasma generated debris in a direction toward the optic 24 from the irradiation site, and, in some cases, may beneficially transport cleaning reaction products, such as tin hydride, from the surface of optic 24, preventing them from decomposing and re-depositing source material back on the optic's surface.

In some implementations, the gas 39 may include an ion-slowing buffer gas such as Hydrogen, Helium, Argon or combinations thereof, a cleaning gas such as a gas which includes a halogen and/or a gas which reacts to generate a cleaning species. For example, the gas may include Hydrogen or a molecule containing Hydrogen which reacts to create a Hydrogen radical cleaning species. As detailed further below, gas which may be of the same or a different composition as the gas 39 may be introduced into the chamber 39 at other locations to control flow patterns and/or gas pressure and gas may be removed from the chamber 26 via one or more pumps such as pumps 41*a,b*. The gasses may be present in the chamber 26 during plasma discharge and may act to slow plasma created ions to reduce optic degradation and/or increase plasma efficiency. Alternatively, a magnetic field (not shown) may be used alone, or in combination with a buffer gas, to reduce fast ion damage. In addition, the exhaustion/replenishment of buffer gas may be used to control temperature, e.g., remove heat in the chamber 26 or cool one or more components or optics in the chamber 26. In one arrangement, for an optic 24 distanced from the irradiation region 48 by a closest distance, d; a buffer gas may be caused to flow between the plasma and optic 24 to establish a gas density level sufficient to operate over the distance, d, to reduce the kinetic energy of plasma generated ions down to the level below about 100 eV before the ions reach the optic 24. This may reduce or eliminate damage of the optic 24 due to plasma generated ions.

Pumps 41*a,b* may be turbopumps and/or roots blowers. In some instances, exhausted gas may be recycled back into the apparatus 10. For example, a closed loop flow system (not shown) may be employed to route exhausted gas back into the apparatus. The closed loop may include one or more filters, heat exchangers, decomposers, e.g., tin hydride decomposers, and/or pumps). More details regarding closed loop flow paths can be found in U.S. Pat. No. 7,655,925, issued on Feb. 2, 2010, entitled GAS MANAGEMENT SYSTEM FOR A LASER-PRODUCED-PLASMA EUV LIGHT SOURCE, and in Application Number PCT/EP10/64140, filed on Sep. 24, 2010, entitled SOURCE COLLECTOR APPARATUS LITHOGRAPHIC APPARATUS AND DEVICE MANUFACTURING METHOD, the contents of each of which are hereby incorporated by reference herein.

Figure 2:
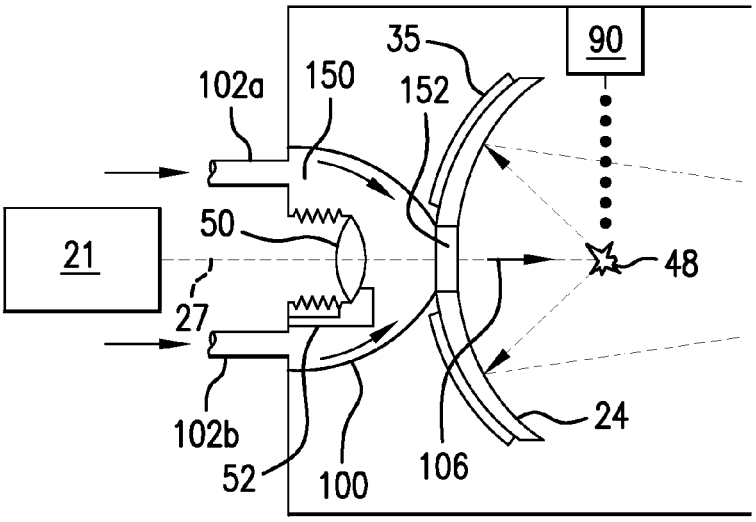
FIG. 2 shows an enlarged portion of the EUV light source shown in FIG. 1 showing the gas flow system in greater detail.

As best seen in FIG. 2, a tapering member 100 which surrounds a volume 150 may be provided. Also shown, a plurality of gas lines 102*a,b* may be arranged to output a gas stream into the volume 150. Once in the volume 150, flow is guided around the optic 50 (which for the embodiment shown is a focusing lens) by the tapering member 100 producing a substantially turbulent free flow which passes through an aperture 152 formed in the optic 24 and flows generally along beam path 27 and toward the irradiation region 48 in the direction of arrow 106. For some gas flows, the operable surfaces of the tapered member may be polished smooth or otherwise prepared to remove burrs, break sharp edges and have a surface roughness $R_a$ not exceeding 100 microns (μm), preferably not exceeding about 10 microns (μm).

In one arrangement, the system generating a gas flow directed toward said target material along said beam path may flow of Hydrogen gas having a magnitude exceeding 40 standard cubic liters per minute (sclm) that is directed around a lens (i.e. optic 50) having a diameter greater than 150 mm without blocking the laser beam travelling along beam path 27. As used herein, the term "hydrogen" and its derivatives include the different hydrogen isotopes (i.e. hydrogen (protium), hydrogen (deuterium) and hydrogen (tritium) and the term "hydrogen gas" includes isotope combinations (i.e. $H_2$, DH, TH, TD, $D_2$, and $T_2$).

Figure 3:
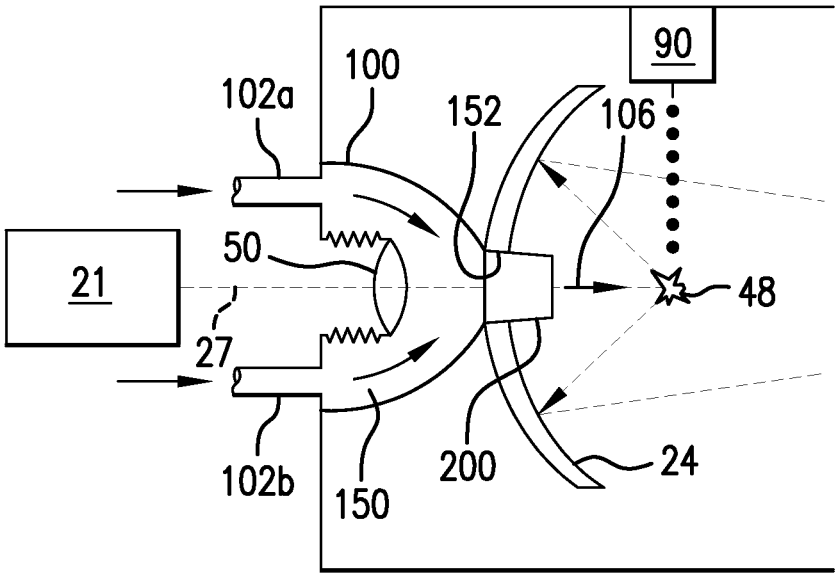
FIG. 3 shows a simplified schematic view of another embodiment of a gas flow system having a shroud.

FIG. 3 shows another example of a system generating a gas flow directed around an optic 50 (which for the embodiment shown is a focusing lens) and toward an irradiation region 48 along a laser beam path 27. As shown, the system may include a tapering member 100 surrounding a volume 150 and a plurality of gas lines 102*a,b* arranged to output a gas stream into the volume 150. For the arrangement shown in FIG. 3, a shroud 200 may be disposed in the aperture 152 of optic 24 and positioned to extend therefrom toward the irradiation region 48. The shroud 200 may taper in a direction toward the irradiation region 48 and in some cases may be cylindrical. The shroud 200 may function to reduce the flow of debris from the irradiation region 48 into the volume 150 where debris may deposit on optic 50 and/or may function to direct or guide a flow of gas from the volume 150 toward the irradiation region 48. The length of the shroud 200 along the beam path 27 may vary from a few centimeters to 10 or more centimeters. In use, gas may be introduced into volume 150 by gas lines 102*a,b*. Once in the volume 150, flow is guided around the optic 50 by the tapering member 100 producing a substantially turbulent free flow which passes through an aperture 152 and shroud 200. From shroud 200, gas may then flow generally along beam path 27 and toward the irradiation region 48 in the direction of arrow 106.

Figure 4:
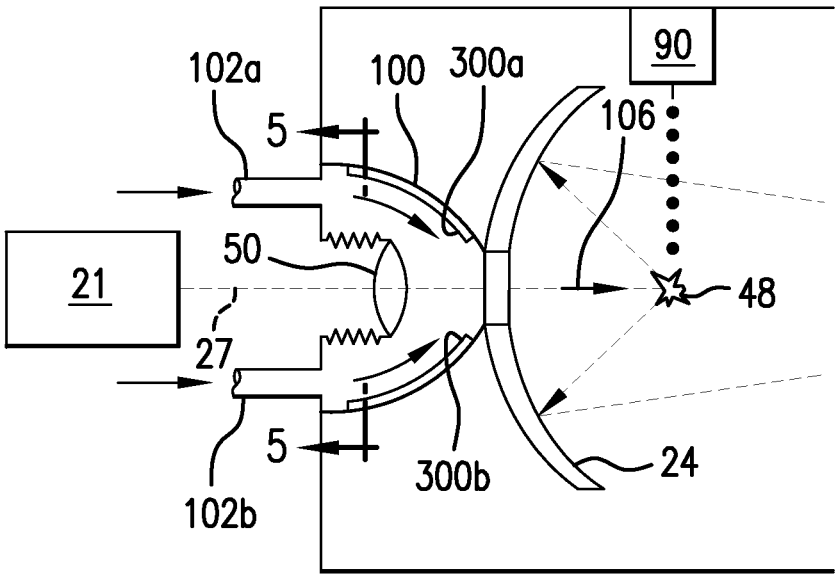
FIG. 4 shows a simplified schematic view of another embodiment of a gas flow system having flow guides which extend into the gas flow from a tapering member.

FIG. 4 shows another example of a system generating a gas flow directed around an optic 50 (which for the embodiment shown is a focusing lens) and toward an irradiation region 48 along a laser beam path 27. As shown, the system may include a tapering member 100 surrounding a volume 150 and a plurality of gas lines 102*a,b* arranged to output a gas stream into the volume 150. For the arrangement shown in FIGS. 4 and 5, a plurality of flow guides 300*a-h* may be attached to or formed integral with the tapering member 100. As shown, each flow guide 300*a-h* may project into the volume 150 from the inner wall of the tapering member 100. Although eight flow guides are shown, it is to be appreciated that when flow guides are employed, more than eight as few as one may be used. Note also, that in some arrangements (i.e. FIG. 2) no flow guides are used. The flow guides may be relatively short, e.g., 1-5 centimeters affecting only flow near the surface of the tapering member 100, or may be longer, and in some cases extending to or near the focusing light cone emanating from the optic 50. In some arrangements, the flow guides may shaped to conform with the light cone. FIG. 5A shows another example in which relatively long, rectangular flow guides 300*a'-c'* are employed. The flow guides may be uniformly distributed around the periphery of the tapering member, or the distribution may be nonuniform. In some cases, a uniform distribution may be modified to accommodate and/or smooth flow around a non-symmetrical flow obstacle, such as the actuator 52 shown in FIG. 2.

Figure 5:
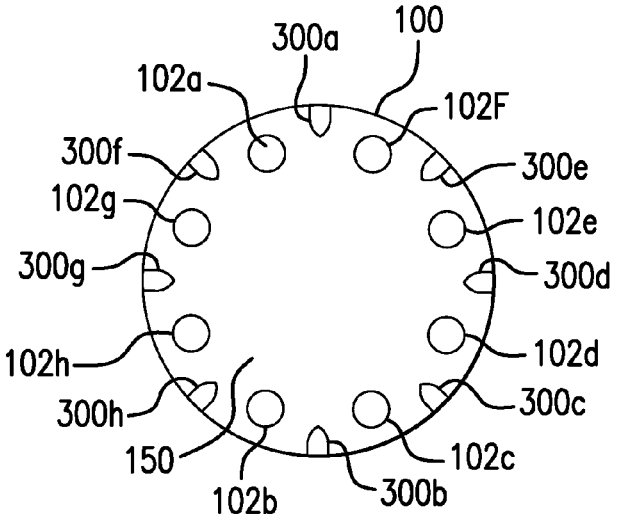
FIG. 5 is a cross-section as seen along line 5-5 in FIG. 4 showing the flow guides and gas lines.
Figure 5A:
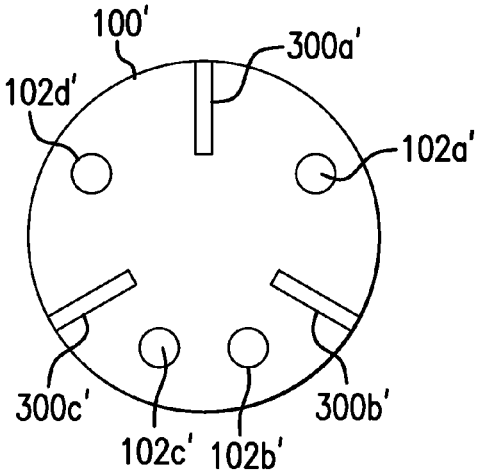
FIG. 5A is a cross-section as seen along line 5-5 in FIG. 4 showing an alternative arrangement of flow guides and gas lines.

Cross referencing FIGS. 4 and 5, it can also be seen that a plurality of gas lines 102*a-h* may be arranged to output gas into volume 150. Although eight gas lines are shown, it is to be appreciated that more than eight, and as few as one, may be used. The gas lines may uniformly distributed around the periphery of the tapering member or the distribution may be nonuniform as shown in FIG. 5A for gas lines 102*a'-c'*. When multiple gas lines are employed, the flow through each gas line may be the same or different from the other gas lines. In some cases, a uniform distribution of gas lines may be modified and/or relative flow rates between gas lines may be modified to accommodate and/or smooth flow around a non-symmetrical flow obstacle, such as the actuator 52 shown in FIG. 2. In use, gas may be introduced into volume 150 by gas lines 102*a-h*. Once in the volume 150, flow is guided around the optic 50 by the tapering member 100, and flow guides 300*a-h* producing a substantially turbulent free flow which passes through an aperture 152, and then flow generally along beam path 27 and toward the irradiation region 48 in the direction of arrow 106.

Figure 6:
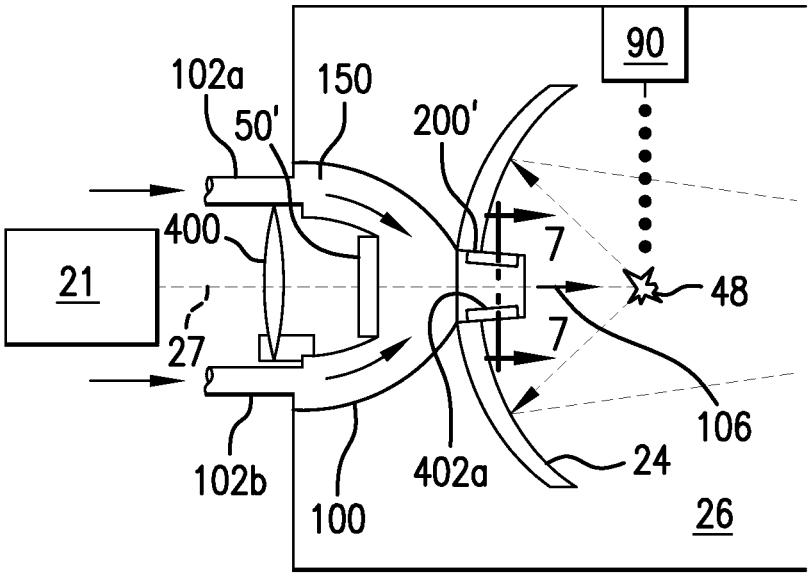
FIG. 6 shows a simplified schematic view of another embodiment of a gas flow system having a shroud and flow guides which extend into the gas flow from the shroud.

FIG. 6 shows another example of a system generating a gas flow directed around an optic 50' (which, for the embodiment shown, is a window) and toward an irradiation region 48 along a laser beam path 27. For the system shown, the window may be provided to allow a laser from laser system 21 to be input into a sealed chamber 26. Lens 400 may be disposed outside of chamber 26 to focus the laser to a focal spot at the irradiation region. In some arrangements (not shown) the lens 400 may be replaced by one or more focusing mirrors, for example and off-axis parabolic mirror may be employed. As shown, the system may include a tapering member 100 surrounding a volume 150 and a plurality of gas lines 102*a,b* arranged to output a gas stream into the volume 150. For the arrangement shown in FIG. 6, a shroud 200' may be disposed in the aperture of optic 24 and positioned to extend therefrom toward the irradiation region 48. The shroud 200' may taper in a direction toward the irradiation region 48 and in some cases may be cylindrical. The shroud 200' may function to reduce the flow of debris from the irradiation region 48 into the volume 150 where debris may deposit on optic 50' and/or may function to direct or guide a flow of gas from the volume 150 toward the irradiation region 48. The length of the shroud 200' along the beam axis 27 may vary from a few centimeters to 10 or more centimeters.

Figure 7:
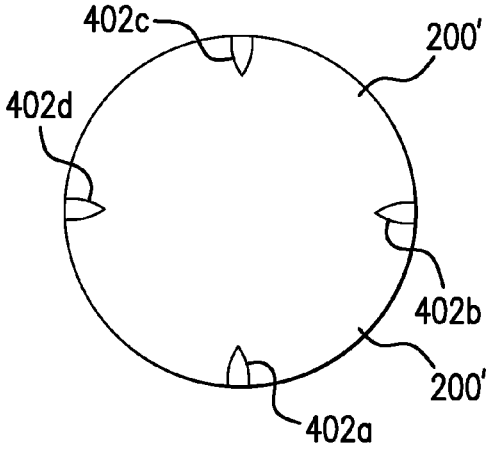
FIG. 7 is a cross-section as seen along line 7-7 in FIG. 6 showing the flow guides.

For the arrangement shown in FIGS. 6 and 7, a plurality of flow guides 402*a-d* may be attached to or formed integral with the shroud 200. As shown, each flow guide 402*a-d* may project from the inner wall of the shroud 200. Although four flow guides are shown, it is to be appreciated that when flow guides are employed, more than four as few as one may be used. Note also, that in some arrangements (i.e. FIG. 3) no flow guides are used. The flow guides may be relatively short, e.g., 1-5 centimeters affecting only flow near the surface of the shroud 200 which is typically designed to be only slightly larger than the converging light cone emanating from the lens 400. In some arrangements, the flow guides may shaped to conform with the light cone. The flow guides may be uniformly distributed around the periphery of the shroud or the distribution may be nonuniform.

In use, gas may be introduced into volume 150 by gas lines 102*a,b*. Once in the volume 150, flow is guided around the optic 50' by the tapering member 100 producing a substantially turbulent free flow which passes through a shroud 200 and flow guides 402*a-d* remaining substantially turbulent-free. From shroud 200, gas may then flow generally along beam path 27 and toward the irradiation region 48 in the direction of arrow 106.

Figure 8:
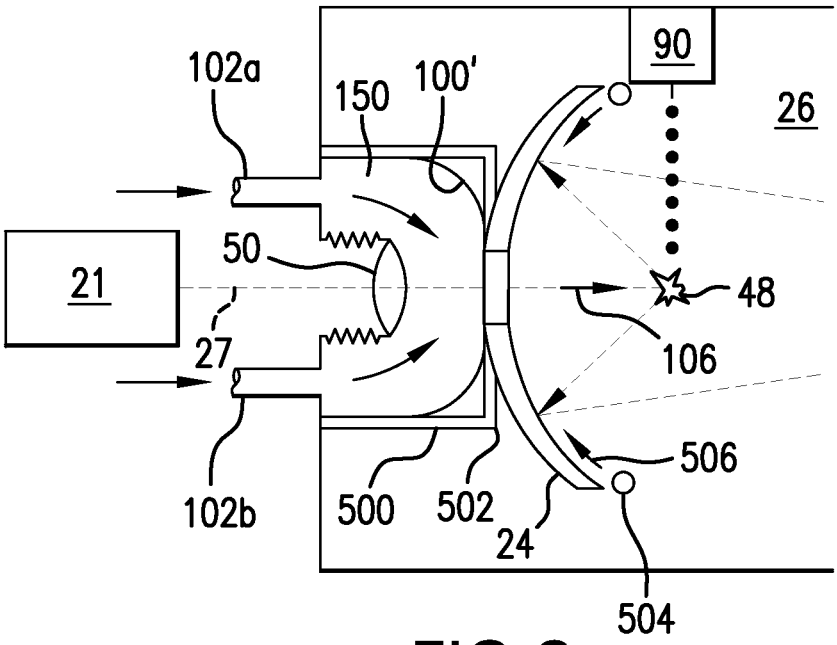
FIG. 8 shows a simplified schematic view of another embodiment of a gas flow system having tapering member for smoothing a sharp corner in a cylindrical housing.

FIG. 8 shows another example of a system generating a gas flow directed around an optic 50 (which, for the embodiment shown, is a focusing lens) and toward an irradiation region 48 along a laser beam path 27. As shown, the system may include a cylindrical housing 500 surrounding a volume 150 and having relatively sharp corner 502. For the gas flow system, a tapering member 100' may be positioned to smooth gas flow near corner 502. FIG. 8 also illustrates that gas may be introduced at other locations in chamber 26. As shown, a manifold 504 may be provided around the periphery of optic 24 to provide a flow of gas along the surface of optic 26 in the direction of arrow 506.

It is to be appreciated that one or more of the gas flow system features of FIGS. 2-8 may be combined. For example, flow guides 300*a* (FIG. 4) may be used with shroud 200 (FIG. 3) or shroud 200' having flow guides 402*a-d*, etc.

While the particular embodiment(s) described and illustrated in this patent application in the detail required to satisfy 35 U.S.C. §112 are fully capable of attaining one or more of the above-described purposes for, problems to be solved by, or any other reasons for or objects of the embodiment(s) above-described, it is to be understood by those skilled in the art that the above-described embodiment(s) are merely exemplary, illustrative and representative of the subject matter which is broadly contemplated by the present application. Reference to an element in the following Claims in the singular is not intended to mean nor shall it mean in interpreting such Claim element "one and only one" unless explicitly so stated, but rather "one or more". All structural and functional equivalents to any of the elements of the above-described embodiment(s) that are known or later come to be known to those of ordinary skill in the art are expressly incorporated herein by reference and are intended to be encompassed by the present Claims. Any term used in the Specification and/or in the Claims and expressly given a meaning in the Specification and/or Claims in the present application shall have that meaning, regardless of any dictionary or other commonly used meaning for such a term. It is not intended or necessary for a device or method discussed in the Specification as an embodiment to address or solve each and every problem discussed in this application, for it to be encompassed by the present Claims. No element, component, or method step in the present disclosure is intended to be dedicated to the public regardless of whether the element, component, or method step is explicitly recited in the Claims. No claim element in the appended Claims is to be construed under the provisions of 35 U.S.C. §112, sixth paragraph, unless the element is expressly recited using the phrase "means for" or, in the case of a method claim, the element is recited as a "step" instead of an "act".

We claim:

1. An extreme-ultraviolet (EUV) light source comprising;
an optic;
a target material;
an EUV mirror having an aperture;
a laser beam passing through said optic along a beam path to irradiate said target material, wherein said optic represents focusing optic to define a focal spot of said laser beam along said beam path; and
a system generating a gas flow directed through said aperture toward said target material along said beam path, said as flow being substantially turbulent-free, said system having a tapering member surrounding a volume and a plurality of gas lines, said tapering member having a small end disposed toward said aperture and a large end disposed opposite said small end to produce substantially turbulent-free flow in a portion of said volume toward said aperture, wherein at least said portion of said volume is disposed between said EUV mirror and said optic, said optic is disposed along said beam path between said large end and said small end within said volume and each gas line of said plurality of gas lines input a gas into said volume from said large end of said tapering member.

2. The light source as recited in claim 1 wherein said member has an inner wall and further comprising a plurality of flow guides projecting from said inner wall.

3. The light source as recited in claim 1 wherein said optic is a window.

4. The light source as recited in claim 1 wherein said optic is a lens focusing said beam to a focal spot on said beam path.

5. The light source as recited in claim 1 wherein said tapering member surrounds said beam path.

6. The light source as recited in claim 1 wherein said gas flow comprises a gas selected from the group of gases consisting of hydrogen (protium), hydrogen (deuterium) and hydrogen (tritium).

7. The light source as recited in claim 1 wherein said tapering member does not extend into said laser beam.

8. The light source as recited in claim 1 wherein said gas flow has a flow magnitude exceeding 40 standard cubic liters per minute (sclm).

9. The light source as recited in claim 1 further comprising a droplet generator producing a stream of target material droplets.

10. The light source as recited in claim 1 wherein said optic is a lens having a diameter greater than 150 mm.

11. An extreme-ultraviolet (EUV) light source comprising;
an optic;
a target material;
an EUV mirror having an aperture;
a laser beam passing through said optic along a beam path to irradiate said target material, wherein said optic represents focusing optic to define a focal spot of said laser beam along said beam path; and
a system generating a gas flow directed through said aperture toward said target material along said beam path, said gas flow being substantially turbulent-free, said system having a tapering guide member having an inner wall surrounding a volume, at least one gas line outputting a gas stream into said volume and a plurality of flow guides projecting from said inner wall, said tapering guide member having a small end disposed toward said aperture and a large end disposed opposite said small end to produce substantially turbulent-free flow in a portion of said volume toward said aperture, wherein at least said portion of said volume is disposed between said EUV mirror and said optic, said optic is disposed along said beam path between said large end and said small end within said volume and said gas stream is flowed into said volume from said large end of said tapering guide member.

12. The light source as recited in claim 11 wherein said optic is a window.

13. The light source as recited in claim 11 wherein said optic is a lens focusing said beam to a focal spot on said beam path.

14. The light source as recited in claim 11 wherein said gas flow has a flow magnitude exceeding 40 standard cubic liters per minute (sclm).

15. The light source as recited in claim 11 wherein said optic is a lens having a diameter greater than 150 mm.

16. A method for producing an extreme-ultraviolet (EUV) light output, said method comprising the acts of;
providing an optic;
providing a target material;
providing an EUV mirror having an aperture;
passing a laser beam through said optic along a beam path to irradiate said target material, wherein said optic represents focusing optic to define a focal spot of said laser beam along said beam path; and
generating a gas flow directed through said aperture toward said target material along said beam path, said gas flow being substantially turbulent-free, said system having a tapering guide member having an inner wall surrounding a volume, at least one gas line outputting a gas stream into said volume and a plurality of flow guides projecting from said inner wall, said tapering guide member having a small end disposed toward said aperture and a large end disposed opposite said small end to produce substantially turbulent-free flow in a portion of said volume toward said aperture, wherein at least said portion of said volume is disposed between said EUV mirror and said optic, said optic is disposed along said beam path between said large end and said small end within said volume and said gas stream is flowed into said volume from said large end of said tapering guide member.

17. The method as recited in claim 16 wherein said optic is a window.

18. The method as recited in claim 16 wherein said optic is a lens focusing said beam to a focal spot on said beam path.

19. The method as recited in claim 16 wherein said gas flow has a flow magnitude exceeding 40 standard cubic liters per minute (sclm) and said optic is a lens having a diameter greater than 150 mm.

* * * * *